United States Patent [19]

Goto et al.

[11] Patent Number: 4,987,438

[45] Date of Patent: Jan. 22, 1991

[54] APPARATUS FOR PROCESSING LIGHT-SENSITIVE MATERIAL

[75] Inventors: Nobutaka Goto, Kashiwa; Shigeharu Koboshi, Sagamihara; Masayuki Kurematsu, Hino; Tomonori Kawamura, Hachioji, all of Japan

[73] Assignee: Konica Corporation, Tokyo, Japan

[21] Appl. No.: 370,323

[22] Filed: Jun. 22, 1989

[30] Foreign Application Priority Data

Jun. 27, 1988 [JP] Japan ..... 63-158757

[51] Int. Cl.[5] ..... G03D 5/04

[52] U.S. Cl. ..... 354/319; 354/324; 354/325

[58] Field of Search ..... 354/305, 319, 320, 321, 354/322, 324, 325, 331

[56] References Cited

U.S. PATENT DOCUMENTS

| | | | |
|---|---|---|---|
| 3,057,282 | 10/1962 | Luboshez | 354/305 |
| 3,120,795 | 2/1964 | Land | 354/321 |
| 4,023,190 | 5/1977 | Fassler | 354/319 |
| 4,178,089 | 12/1979 | Spence-Bate | 354/319 |
| 4,324,479 | 4/1982 | Sachs | 354/331 |
| 4,669,847 | 6/1987 | Taniguchi et al. | 354/324 |
| 4,758,857 | 7/1988 | Tanaka | 354/324 |

*Primary Examiner*—A. A. Mathews

*Attorney, Agent, or Firm*—Finnegan, Henderson, Farabow, Garrett, and Dunner

[57] ABSTRACT

A photosensitive material developer for developing a photosensitive material comprising a processor for developing the photosensitive material with a developer in a developer tank which is filled with the developer so that the developer is insulated from air.

14 Claims, 20 Drawing Sheets

100
102
102

100
102
102

100
102
102

102
102
100

102
102
100

102
102
100

100
102
102

APPARATUS FOR PROCESSING LIGHT-SENSITIVE MATERIAL

BACKGROUND OF THE INVENTION

The present invention relates to an apparatus for developing light-sensitive materials; particularly to the technology for providing a compact developing apparatus in which the developing solution in a small sized developing tank is substantially hermetically sealed from outside air, in order to prevent oxidization and evaporation of the developing solution.

Processing apparatuses of a conventional type have had processing tanks in the form of an open top bucket and it has been impossible to overcome the problem of processing solution leaking through small cracks or gaps on the side or the bottom of the processing tank. In these types of processing tanks it has been impossible to tightly close the opening in the upper portion of the processing tank where light-sensitive materials pass through. Therefore, a floating cover was placed on the surface of the processing tank, or a certain type of gas which is inert with the processing solution was filled in the upper portion of the processing tank, or a certain type of floating materials which is endurable against the processing solution, was floated thereon for the purpose of reducing the area of the surface of the processing solution. However, the oxidization by air or the evaporation of the processing solution still could not be prevented. So, the level of processing characteristics for light-sensitive materials is very difficult to be kept stable. Especially, in the photo-finishing laboratory (shop) where color photographic processing is small in quantity, the control of the processing solution stability seems to be almost impossible to conduct.

The method to decrease the area where processing solution in the processing tank contact the air is only effective for the decrease of the ratio of the deterioration by oxidization or evaporation of the developer. The above method cannot prevent the deterioration or evaporation of the developer effectively or completely. Especially in case where the operation ratio of the light-sensitive material processing apparatus is extremely low, it is supremely important to prevent the deterioration or evaporation of the propcessing solution from the view point of maintaining the level of color photographic developing quality stable or decreasing the operation cost of the processing apparatus.

Moreover, in case of the conventional open top processing tank, the processing solution warps upward at the contact point between the wall of the tank and the processing solution. So, as the area of the liquid contacting air in this portion is increased and therefore the oxidization begins to contaminate the processing tank, the oxidized solid portion falls into processing solution. This becomes one of the causes of trouble in processing. Therefore, various methods have been studied to solve this problem. If a photosensitive material can be fed directly into the processing solution under the condition that the processing tank is hermetically kept and fully filled with the processing solution and expelling the air inside the processing tank completely, contact between air and the processing solution in the tank cannot happen, resulting in effective prevention of deterioration by oxidization or evaporation. In the above-mentioned method, however, the important technical theme is how to feed the photosensitive material directly into the processing solution without leakage of the processing solution from the processing tank having therein an inlet for a light-sensitive material. The present invention was devised from the above-mentioned viewpoint. The object of the present invention is to provide a light-sensitive material processing apparatus and method in which deterioration by oxidization and evaporation of the processing solution in the processing tank are prevented and a light-sensitive material can be fed directly into the processing solution without leakage.

SUMMARY OF THE INVENTION

The light-sensitive material processing apparatus of the present invention is superior in solving the above-mentioned problem. The apparatus has at least one processing tank kept hermetic and light-sensitive materials are fed into the processing tank where the processing solution in the tank is intercepted and isolated from air outside, during processing.

The processing tank has a valve device, gap and so on by which light-sensitive materials can be fed, and through which the processing solution does not substantially leak.

The processing tank, where the processing solution is intercepted and substantially isolated from the air outside has at least one pair of valve devices, by which light-sensitive materials can be passed in and out. It is so arranged that the light-sensitive materials are passed and conveyed through the valve device into the processing tank. By this device, the inside of the processing tank can be in contact with the air outside of the tank through the valve device.

The processing tank also uses a flexible material for the valve device, so that a gap is generated when the light-sensitive materials pass through the tank and the processing tank may be kept hermetically so that no leakage of the processing solution occurs when light-sensitive material passes through the tank.

In the latter case, it may be good to provide a roller and so on in order to convey light-sensitive materials inside of the processing tank and/or in the intermediate room provided, according to the necessity, between the processing tanks.

In the processing tank which is kept hermetic as mentioned above, a valve device which enables light-sensitive materials to be inserted into and ejected from the processing tank can be provided. Besides, a water tank which provides to the valve device with hydraulic pressure, which is equal to fluid pressure of the processing solution, can be provided to keep the processing tank substantially hermetic. Besides, a transport mechanism that transports a light-sensitive material can be provided in the processing tank.

Further, it is possible to provide a means to eject compulsorily, the processing solution in the processing tank kept substantially hermetic by replenishing a replenisher through the replenisher supplying inlet of the processing tank.

By washing successively or intermittently the outside of at least one of the light-sensitive material feeding or ejecting devices provided on the processing tank, it is possible to prevent the oxidization by air or the hardening by evaporation on the device.

In case where the processing tanks are arranged successively, water, fluid paraffin and inert gas may be filled in the midway room, which is formed by the entering and exausting devices between each processing tank, for the purpose of preventing the oxidization by air or the hardening by evaporation aforesaid device.

By providing the mechanism for releasing the hermetical condition of the processing tank which is substantially hermetic with the outside air of it, it is possible to attain smooth exhaustion of processing solution when supplying the processing solution to the processing tank at the start of the operation or on occasion of maintenance.

Moreover, it is possible to provide a guide in the processing tank for the smooth feeding of light-sensitive materials, to provide a circulation system of the processing solution for enhancing the agitating effect by jetting processing solution onto light-sensitive material in the processing tank, for enhancing the temperature control effect, and for eliminating impurities in the processing solution by the method of filtrating and so on.

In this light-sensitive processing apparatus, the processing tank is isolated from the outside air, and the processing solution has no contact face with air. Therefore, the processing solution cannot contact the air, which results in that deterioration by oxidization and evaporation of the processing solution can be prevented in the processing tank. The stability of the processing solution in the processing tank can be enhanced extremely. So, the processing apparatus can be made small and at the same time, the maintenance of the processing apparatus can be simplified. Moreover, even when the amount of processing solution decreases, after the processing of light-sensitive material, the solution can be kept uncontacted with air by the replenishment of the processing solution or by using flexible materials in the processing tank to decrease the volume of the processing tank. The side wall of the processing tank has at least one valve device to seal the wall of the processing tank. Moreover, the light-sensitive material can be fed into and ejected directly from the processing solution from the side wall of the processing tank through this device, at the same time the processing tank is kept hermetic with the outside air. Thus, the sealing capacity can be kept, so the leakage of liquid which takes place when a light-sensitive material is conveyed into or ejected out of the processing tank, can be reduced.

Thus, in case where not only at least one valve device forms a part of the wall of the processing tank, but also the roller structure forms a feeding-in and ejecting-out mechanism, they have a light-sensitive material feeding function. So, it is not necessary to provide a complicated roller mechanism or guide mechanism for the feeding of light-sensitive material into the processing tank as is conventionally done.

When the valve device is provided to in the processing tank which is kept hermetic so that the light-sensitive materials can be fed-in and ejected-out, isolation can become easy. Moreover, it is possible to provide a water tank that has a hydraulic pressure which is equal to the fluid pressure of the solution. Due to this, leakage of solution when the light-sensitive material passes through the valve device can be prevented. Due to the conveying mechanism provided in the processing tank, the light-sensitive material in the processing tank can be fed without leakage. Besides, by supplying a replenisher compulsorily with a use of pump and so on from the replenisher supplying inlet, provided in the processing tank which is being substantially isolated from the outside air, the processing solution in the processing tank can be exhausted from the processing tank through a narrow gap surrounding the valve device. In this case, a washing effect occurs. The processing solution exhausted out of the processing tank stays in the exhausted solution tank as waste liquid.

Moreover, to this isolated developing tank a circulation system can be provided for agitating and controlling temperature of the processing solution in the processing tank to achieve stable processing.

It is desirable, from the standpoint of preventing the damage of the surface of the light-sensitive material, to provide a filtrating device which is kept hermetic with the outside air of it in the route of the circulation system so as to exhaust unsoluble impurities which are accumulated in the processing solution.

During temperature conditioning of the processing solution, it is not preferable to use a heater of relatively high capacity when the quantity of circulated solution is small, because the heating of the temperature becomes critical. On the contrary, when a small capacity heater is used and the circulating solution quantity is big, the heating is to small to realize good control. But, in this case, the circulating solution quantity is so big that the fluctuation of power for the pump and of the pressure in the processing tank occurs which is not be considered a good method from the viewpoint of stable processing.

We tested the relation between the heat load quantity (wherein the heat load quantity is equal to the heater output divided by the quantity of circulating solution) and the range of controlled temperature. The result is shown in FIG. 35.

The guide parts which convey the light-sensitive materials are provided in the processing tank. The guide parts realize smooth conveyance of light-sensitive material. Besides, by providing open-holes from which the developer blows onto the light-sensitive material, uneaveness decreases during processing of the light-sensitive material. At the same time, as the light-sensitive material is fed and floated from the guide material, the light-sensitive material is prevented from receiving a scratch on its face or generates a jumming during the guide part. Various tests were conducted to determine the relation between the hole opening ratio of the guide material and developing unevenness, and between the speed of the solution to be splashed and the developing unevenness. The results are shown in Table-1 and Table-2. According to the results of the tests, the hole opening ratio of the guide material should be not less than 15%, and more preferably not less than 20%, and the speed of the solution to be splashed to the light-sensitive material should be not less than 1.0 cm/sec., and more preferably not less than 1.5 cm/sec.

The processing tank is provided with a mechanism for releasing the hermetic condition and opening the tank to outside air for filling or discharging processing solution. The processing solution in the processing tank is in contact with the outside air through the valve device, and by feeding light-sensitive material a part of the processing solution is leaked from the tank. For the prevention of the air from oxodizing the processing solution at this point, the surface of the valve device is washed with water succesively or intermittently.

Besides, it is possible to provide a structure to fill water, fluid paraffin, inert gas and so on, that have no influence on the processing, into the midway room between the processing tanks so that air oxidization, evaporation and so on can be prevented.

FIG. 1 shows the general form of the light-sensitive material processing apparatus which uses a principal roller structure. Also, FIG. 2 shows the installation of the roller structure in the processing tank and the conveying of the light-sensitive material. Further, FIG. 3 shows the arrangement in the processing tank, although the invention is not limited only to this arrangement.

In case of color film processing, what is important is the stability of the temperature for processing.

For this method, normally a heater is inserted into the processing tank, and the processing solution is agitated or circulated with the circulation pump. In the processing tank of the present invention, the processing solution may be circulated with a pump, but the heater can be built in the guide in the processing tank as shown in FIG. 28. Also, the heater can be built in the processing tank as shown in FIG. 29 and FIG. 30. Agitating of the solution in the processing tank can be done as shown in FIG. 31 and FIG. 33. Besides, as shown in FIG. 32, the light-sensitive material itself can vibrate the fin-type agitating plate which it is set in the guide, so as to agitate the processing solution at the time of the feeding of light-sensitive material. In order to decrease the variation in the range of temperatures of the processing solution, it is possible to take the following measures: a heater of large capacity is set outside of the processing tank and, a heater of small capacity is set inside the processing tank, whereby the temperature of the solution is increased by the outer heater, and the adjustments of the temperature of the solution are done by the inner heater.

BRIEF DESCRIPTION OF THE DRAWINGS

FIG. 22 is the side view of the symptom and FIG. 23 is the bottom view.

DETAILED DESCRIPTION OF THE INVENTION

Figure 1:
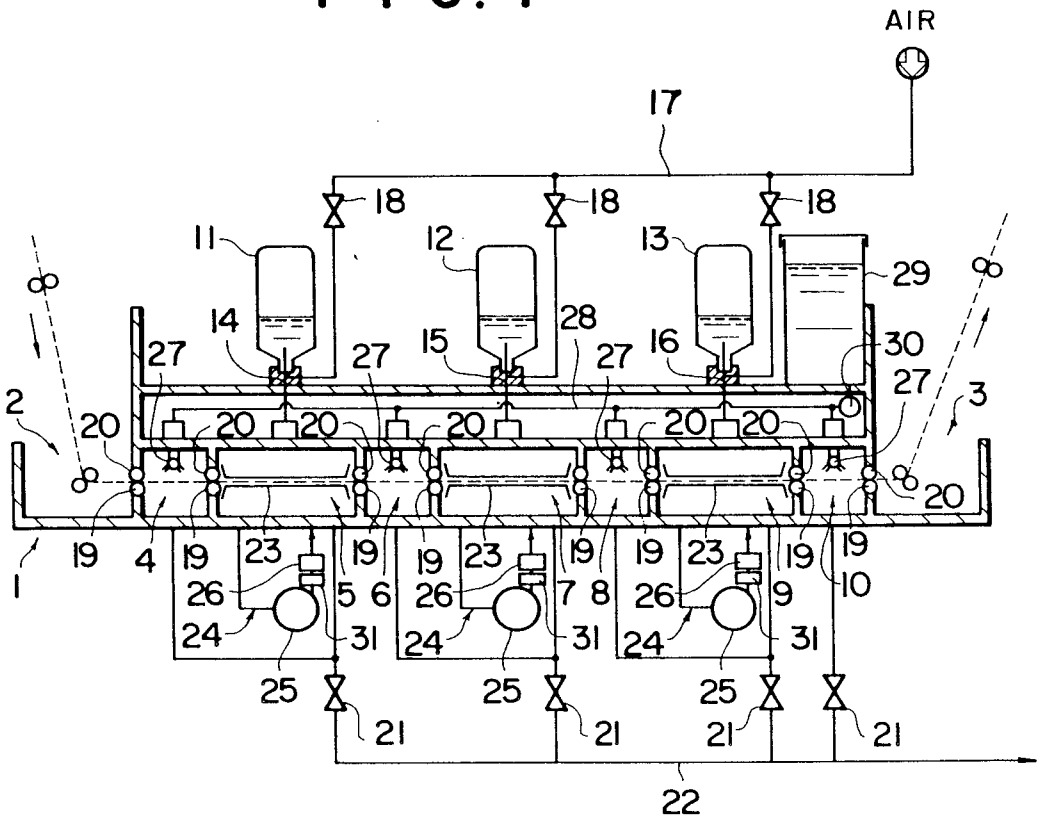
FIG. 1 shows a general drawing of a light-sensitive material processing apparatus of the present invention.

Examples of the invention will now be explained in detail, referring to the drawings attached.

FIG. 1 is a schematic diagram showing an apparatus for processing light-sensitive materials to which the present invention is applied.

In FIG. 1, the numeral 1 represents an apparatus main body provided with a light-shielding device that intercepts external light so that it may not enter the apparatus. Apparatus main body 1 is provided with inlet 2 on one side of the apparatus and outlet 3 on the other side thereof, both for light-sensitive materials. Between inlet 2 and outlet 3, there are provided in sequence from the side of inlet 2, washing section 4, developing tank 5, washing section 6, fixing tank 7, washing section 8, washing tank 9 and washing section 10.

Developing tank 5, fixing tank 7 and washing tank 9 hermetically contain developer, fixer and washing water, respectively. These processing tanks are provided with replenisher containers 11, 12 and 13 which are connected to the tops of processing tanks through pipes 14, 15 and 16, respectively and a liquid-level of each processing tank is formed in each of replenisher containers 11, 12 and 13. Pipes 14, 15 and 16 are connected to air pipe 17 that leads to outside air, and the hermetic condition in each tank is released when air flows through valve 18, when it is opened.

On each partitioning wall separating washing section 4, developing tank 5, washing section 6, fixing tank 7, washing section 8, washing tank 9 and washing section 10 respectively, there are provided a pair of rollers, upper roller 19 and lower roller 20. The rollers are arranged with a clearance between them which substantially prevents a leakage of liquid therethrough and still allows a light-sensitive material to pass therethrough. Though there are slight gaps between rollers or between the wall of an apparatus main body and the rollers, liquid leakage is substantially prevented because the processing tanks are under hermetic conditions. Due to the rotation of rollers 19 and 20, a light-sensitive material fed into inlet 2 is transported through washing section 4, developing tank 5, washing section 6, fixing tank 7, washing section 8, washing tank 9 and washing section 10 in succession, and leaves outlet 3 in a processed state.

Developing tank 5, fixing tank 7 and washing tank 9 are kept hermetic. Therefore, processing solutions neither leak nor contact air in processing tanks, resulting in the prevention of deterioration of processing solutions caused by oxidization and vaporization thereof. Therefore, contamination in the shape of tar caused by oxidization does not take place in a processing tank of the present invention. Further, the roller device composed of rollers 19 and 20 are arranged close enough to each other to form a seal but are able to rotate to allow a light-sensitive material to be fed into a processing tank through the rollers by their rotation. In addition, each processing tank is kept hermetic, and thereby liquid leakage from rollers 19 and 20 which is most likely on the occasion of insertion and ejection of a light-sensitive material is substantially prevented.

For the replacement of processing solutions, when valve 18 is opened for connection to outside air, each processing tank is released from its hermetic condition and waste solutions are discharged from the clearance between rollers 19 and 20 into washing sections 4, 6, 8 and 10, and are finally discharged from pipe 22 when valve 21 is opened.

It is not necessary to provide a special device for transporting a light-sensitive material because rollers 19 and 20 are a part of a wall of the processing tank, the tank is kept hermetic and further transport a light-sensitive material when they rotate.

On each of developing tank 5, fixing tank 7 and washing tank 9, there are provided guides 23 which face each other at a predetermined distance, and these guides form a transport path that smoothly transports the light-sensitive material into the processing tanks, with its emulsion side facing downward. Though there are no restrictions as to whether the emulsion side faces downward or upward, it is desirable that jets of processing solutions may be directed onto the emulsion side. Further, when processing solutions in a processing tank are stirred sufficiently, due to the circulation of processing solutions, the emulsion side may face upward where no inlet for the circulation of processing solutions is provided. Guide 23 is provided with apertures which will be described later, and a light-sensitive material is splashed with processing solutions coming from these apertures when circulation system 24 is driven, and the processing solutions are transported. It is desirable that guide 23 is provided with apertures that are not less than 15%, more preferably not less than 20% of the guide in terms of area, and through these apertures, processing solutions are directed onto a light-sensitive material at a speed of 1.0 cm/sec or more, or more preferably of 1.5 cm/sec or more. Owing to the jets of processing solution, contact resistance between a light-sensitive material and guide 23 forming a transport path is lightened and the stirring of processing solutions is improved, resulting in the prevention of streaks caused by uneven processing.

The width of a transport path formed by guide 23 is set to the value equivalent to the width of a light-sensitive material plus about 5 mm, and thereby the light-sensitive material is prevented from being jammed. Further, when jets of processing solutions are directed at an angle in the transport direction, the light-sensitive material is transported smoothly by the flow of processing solutions.

Further, it is possible to reduce the resistance caused by friction between the light-sensitive material and guide 23 by providing a streak pattern forward of the conveyance direction on the surface of guide 23 facing the light-sensitive material.

Circulation system 24 provided on each of developing tank 5, fixing tank 7 and washing tank 10 is composed of circulation pump 25, heater 26 and filter 31. The system circulates processing solutions in each of the processing tanks which are kept hermetic, homogenizes the composition of processing solutions in developing tank 5 and fixing tank 7, and may remove sediment and foreign materials in each of the processing solutions while keeping the temperature thereof constant. For washing tank 9, system 24 may further adjust temperature for washing and may stir washing water for efficient washing.

As far as the time required for processing is concerned, each of developing processing, fixing processing and washing processing requires, for example, 30 seconds and less.

Injection nozzle 27 is provided in each of washing sections 4, 6, 8 and 10 which are connected through pipe 28, to washing water tank 29, which supplies water to each of washing sections 4, 6, 8 and 10 by means of washing water pump 30. There is no particular restriction for supplying washing water, and it is possible to wash by means of a jet from injection nozzle 27 toward rollers 19 and 20 when processing is finished or during the stand-by period before processing. It is further possible to cause washing sections 4, 6, 8 and 10 to be jetted constantly by washing water so that rollers 19 and 20 may be washed constantly during the processing period.

Further, it is possible to keep the intermediate chamber portion of each of washing sections 4, 6, 8 and 10 filled with washing water so that rollers may be washed continuously.

Figure 2:
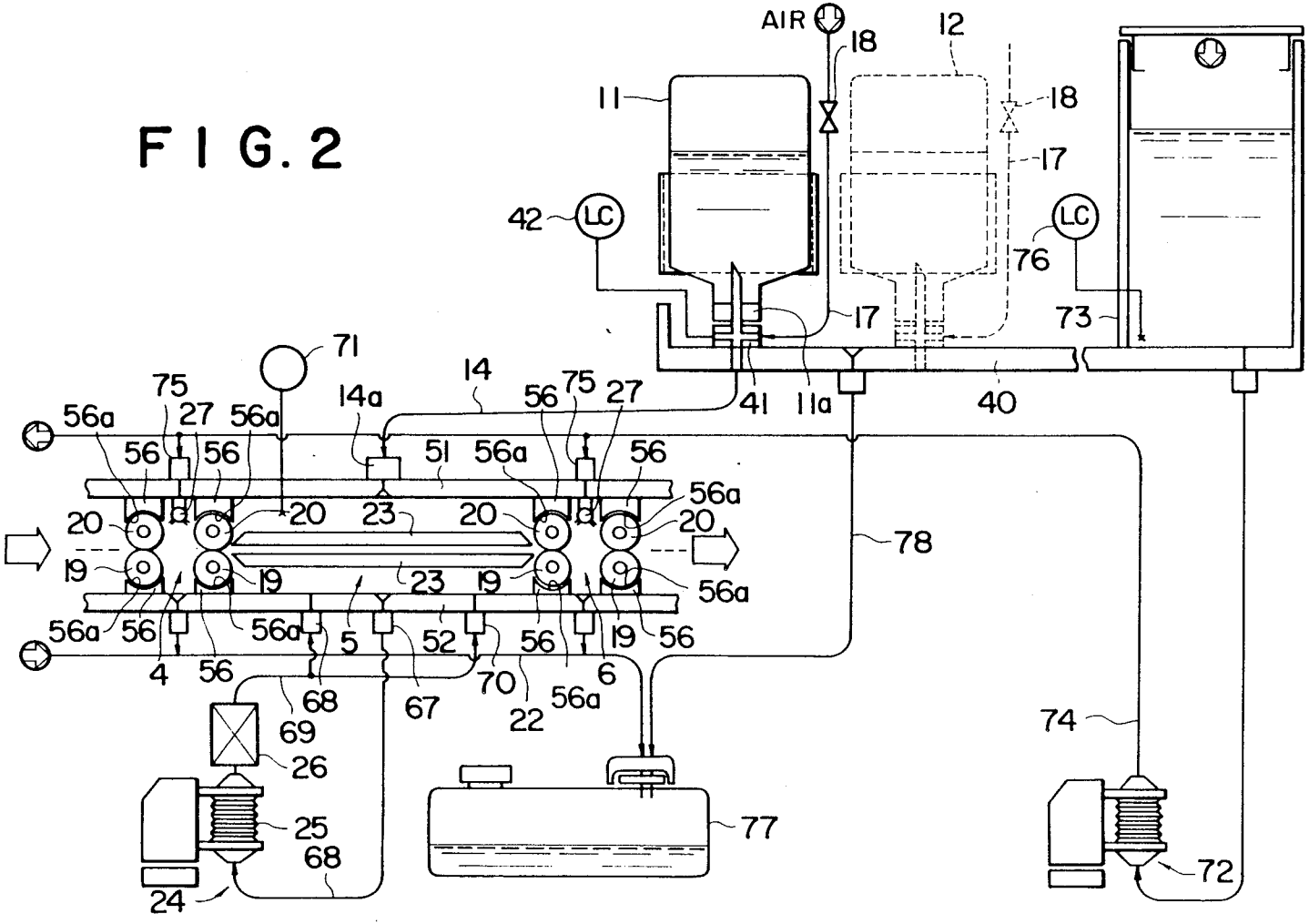
FIG. 2 shows a schematic diagram of the development processing part.
Figure 3:
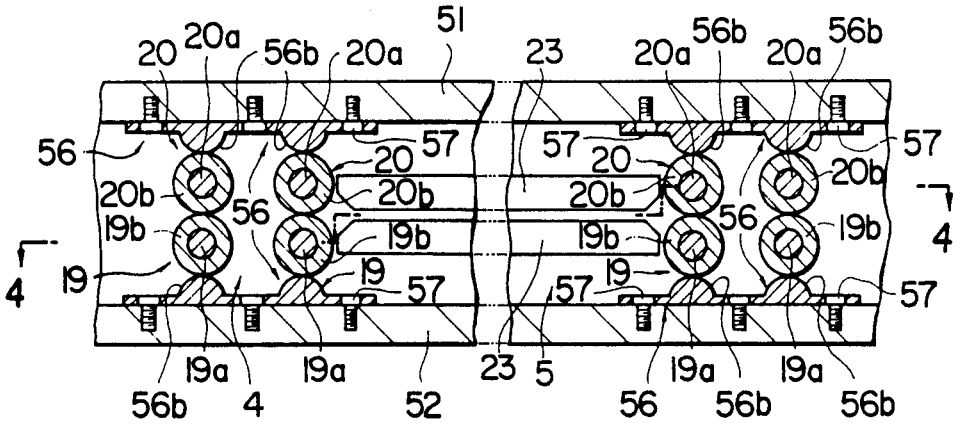
FIG. 3 shows the front view of the developing tank.
Figure 4:
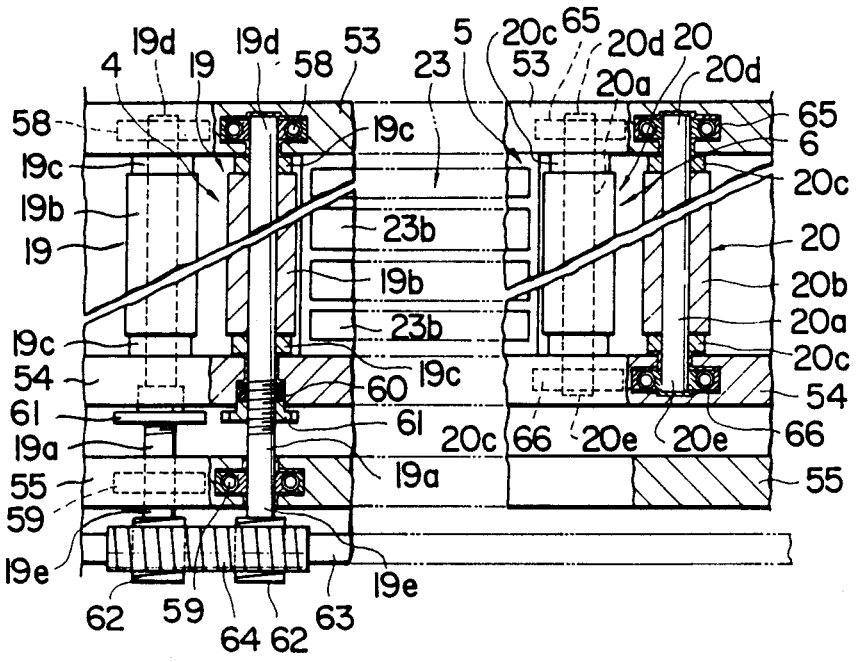
FIG. 4 shows a cross sectional view taken along line IV—IV of FIG. 3.
Figure 5:
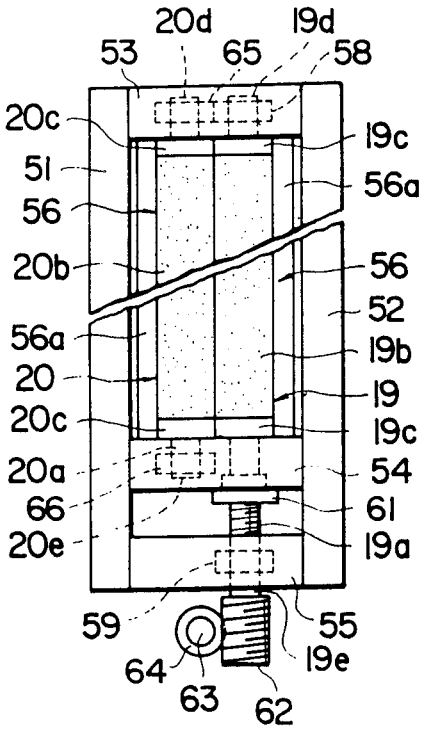
FIG. 5 is a right side view of FIG. 4.
Figure 6:
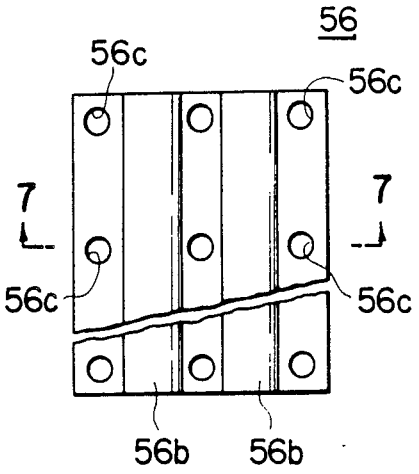
FIG 6 is a plan view of the sealing member.
Figure 7:
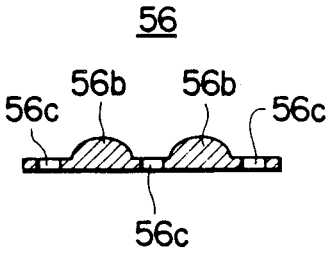
FIG. 7 is a cross sectional view taken along line VII—VII of FIG. 6.
Figure 10:
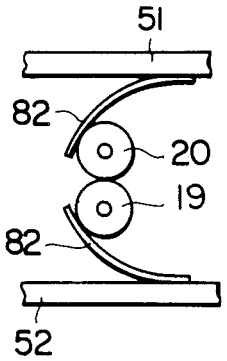
Figure 11:
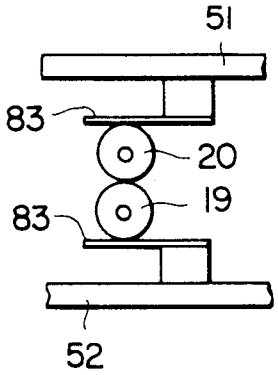
Figure 12:
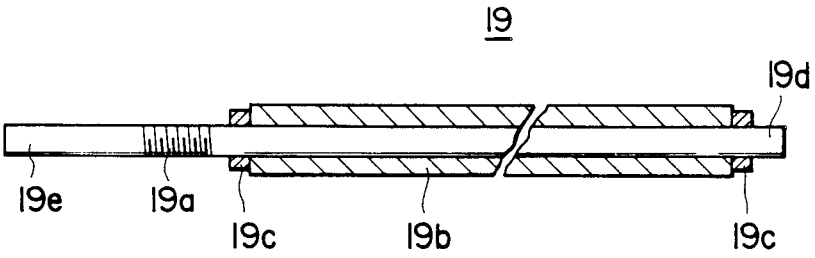
FIG. 12 and FIG. 13 are cross sectional views of the roller.
Figure 13:
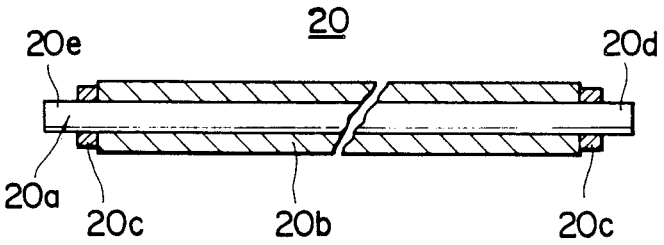
Figure 14:
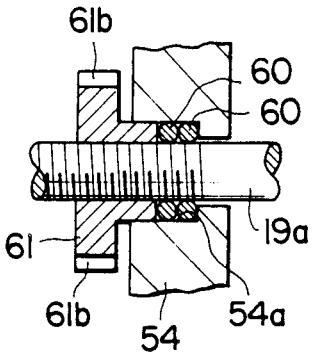
FIG. 14 is an enlarged cross sectional view of the roller seal section.
Figure 15:
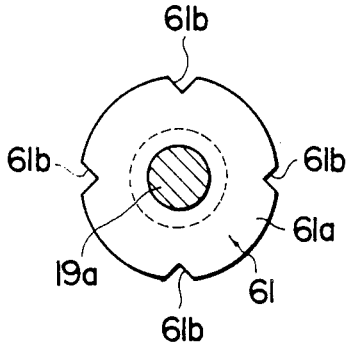
FIG. 15 is a right side view of FIG. 14.
Figure 16:
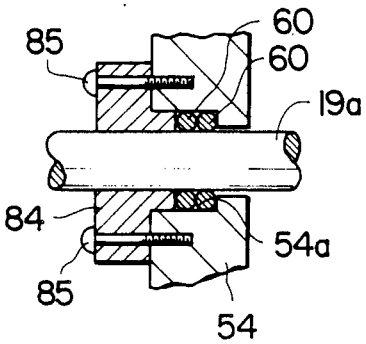
FIG. 16 is an enlarged cross sectional view of another example of the roller seal section.
Figure 17:
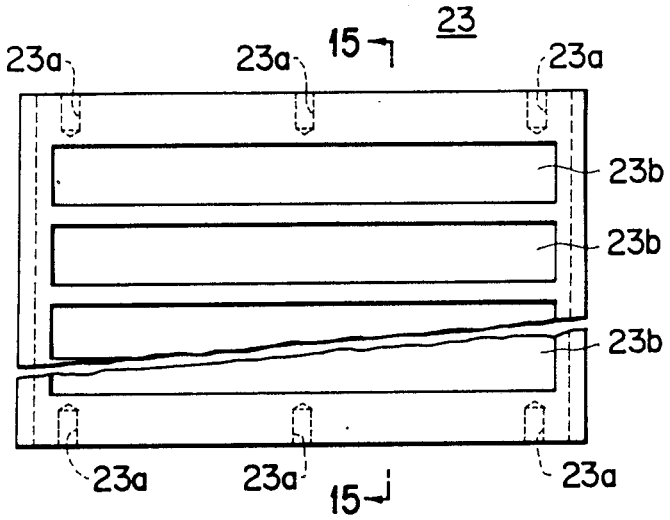
FIG. 17 is a plan view of the guide.
Figure 18:
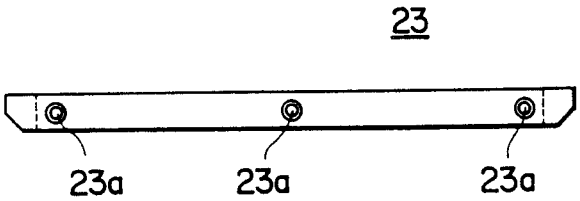
FIG. 18 is a front view of the guide.
Figure 20:
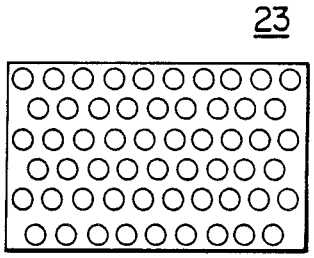
FIG. 20 and FIG. 21 represent top views of another example of the guide.
Figure 19:
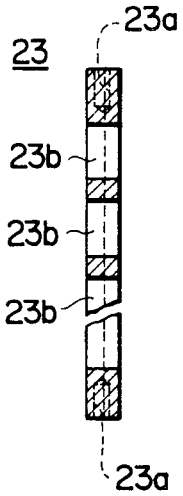
FIG. 19 is a cross sectional view taken along line XIX—XIX of FIG. 17.
Figure 21:
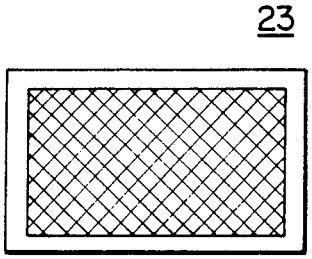
Figure 22:
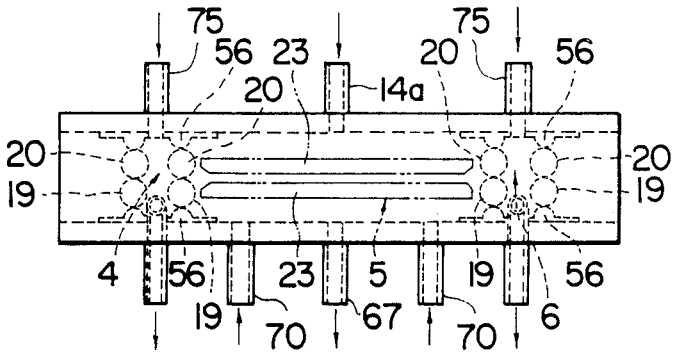
FIG. 22 and FIG. 23 show the supplying part and the draining part of the circulating system of the developing tank.
Figure 23:
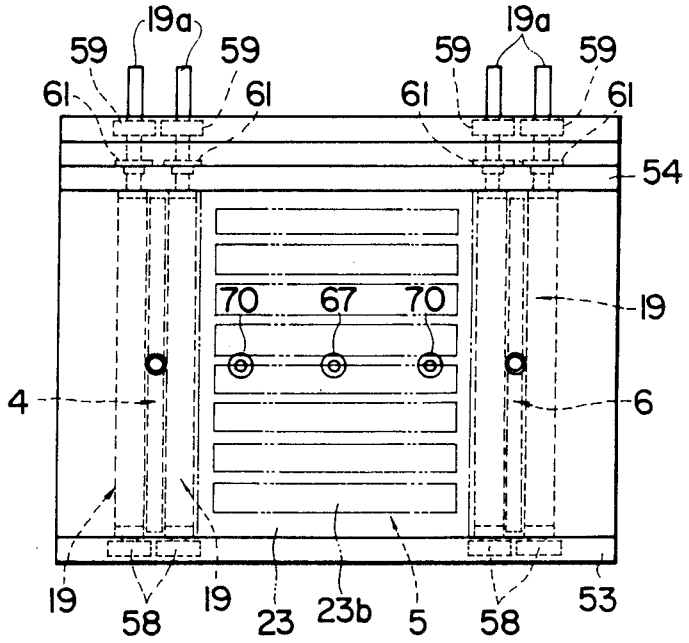

FIGS. 2–23 show an apparatus for processing light-sensitive materials which is more concrete, FIG. 2 is a schematic diagram of a developing section, FIG. 3 is a front view of a developing tank, FIG. 4 shows a sectional view taken on line IV—IV in FIG. 3, FIG. 5 is a right side view of FIG. 4, FIG. 6 is a top view of a sealing member, FIG. 7 is a sectional view taken on line VII—VII in FIG. 6, FIGS. 8–11 show sectional views of other examples for a sealing member, FIGS. 12 and 13 show a sectional view of a roller, FIG. 14 is an enlarged sectional view of a roller sealing portion, FIG. 15 is a right side view of FIG. 14, FIG. 16 is an enlarged sectional view of another example of a roller sealing portion, FIG. 17 is a top view of a guide, FIG. 18 is a front view of a guide, FIG. 19 is a sectional view taken on line XIX—XIX in FIG. 17, FIGS. 20 and 21 show other top views of a guide, and FIGS. 22 and 23 show a supplying portion and an ejecting portion for a circulation system of a developing tank in which FIG. 22 shows a side view thereof and FIG. 23 shows a bottom view thereof.

The developing section will be explained in the present example. The fixing section and the washing section are the same as the developing section in terms of constitution.

For the connection between replenisher tank 11 of developing tank 5 and pipe 14, stopper portion **11*a* of replenisher tank 11 is arranged as shown in FIG. 2, so that it may be pierced by holding portion 41 which is connected to pipe 14 provided on rest 40 and has a sharp tip, which prevents liquid leakage. Further, it is possible to locate replenisher tank 11 under the processing tank for the forced supply of replenisher by means of a pump, without connecting in the aforesaid way. The developer in replenisher tank 11 is supplied to developing tank 5 from supplier section 14*a* through pipe 14. Replenisher tank 11 can easily be attached to or detached from holding portion 41**, resulting in simple replacement work.

Developing solution is supplied to developing tank 5 from pipe 14 through supply section 14*a*, and detection sensor 42 that detects the remaining amount of processing solution in replenisher tank 11 is provided on mounting section 41 for pipe 14 and the detection sensor 42 when it operates indicates when replenisher tank 11 should be replaced. Further, air pipe 17 that leads to outside air is connected to the mounting section 41 for pipe 14 and the air pipe 17 is provided with valve 18 which keeps, when it is closed, developing tank 5 hermetic. On the occasion of the replacement of developer in developing tank 5, when valve 18 is opened, the atmospheric pressure causes the developer to be discharged from the portion of developing tank 5 where rollers 19 and 20 are provided. The replacement of solution is completed when the valve 18 is closed for keeping developing tank 5 hermetic, fresh developer is supplied therein and replenisher tank 11 is set. In the replenisher tank 11, only the top portion of the solution therein is oxidized, which causes no oxidized developer to flow into developing tank 5. Further, when it is arranged that the replenisher tank is filled with inert gas, without contacting outside air, it is possible to prevent the oxidization of developer in replenisher tank 11. When a flexible material is used for the replenisher tank, such as a polyethylene container, it is possible to feed developer into developing tank 5 simply through a valve, instead of causing the replenisher tank to contact outside air.

Upper wall 51 and lower wall 52 of developing tank 5 are arranged in parallel to be adjacent each other, and between upper wall 51 and lower wall 52, there are provided rear wall 53 and middle wall 54 as shown in FIGS. 4 and 5 and front wall 55 is further provided in the vicinity of middle wall 54. On the front side where the driving mechanism for rollers is provided, there is allocated a further space which forms a double structure for the prevention of liquid leakage.

Each of the partition walls separating developing tank 5 and washing sections 4 and 6 provided at the front and the rear of developing tank 5 respectively are formed by rollers 19 and 20. Namely, each inside of upper wall 51 and lower wall 52 is provided with sealing member 56 as shown in FIG. 2 so that both sealing members face each other. The sealing member 56 is provided with a spherical concave 56*a* and the spherical concave and rollers 19 and 20 are installed in a condition whereby liquid leakage is prevented and yet rollers 19 and 20 can rotate.

Sealing member 56 may be formed so that it may have convex stripe 56*b* whose sectional view is of a semicircle shape as shown in FIGS. 3–7. In this case, sealing member 56 is fixed on the inside surface of each of upper wall 51 and lower wall 52 by means of screws 57 and screw holes 56*c*, and a pair of rollers 19 and 20 are arranged between convex stripes 56*b* so that they may contact convex stripes 56*b* with pressure.

Figure 8:
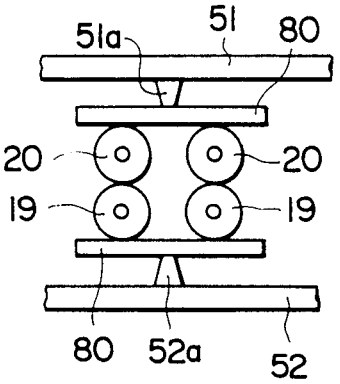
FIG. 8–FIG. 11 are front views of the examples of the roller seal.
Figure 9:
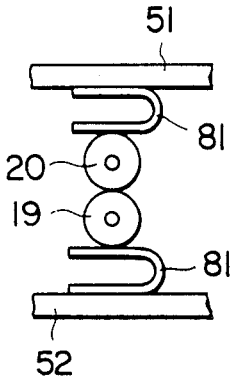

Shown in FIG. 8 is a sealing member, thin plate 80, made of an elastic material which is held against rollers 19 and 20 through protrusions 51*a* and 52*a* formed on the inside of upper wall 51 and lower wall 52, thus preventing liquid leakage between rollers and the apparatus main body. The thin plate 80 is kept in contact with a roller by pressure, preventing liquid leakage between the apparatus main body and rollers. Thin plate 80 may be made of any material if the material is sufficiently elastic and resistant against processing solutions. In the example, a pair of rollers are sealed with one plate, but one roller may naturally be sealed with one plate. Further, in addition to the above, various sealing methods are available including one wherein a pair of rollers 19 and 20 are supported with supporting members 81–83 as shown in FIGS. 9–11.

Each of rollers 19 and 20 is composed, as shown in FIGS. 12 and 13, of shaft portion 19*a* or 20*a* and roller portion 19*b* or 20*b* provided around the shaft portion, as well as end roller portion 19*c* or 20*c*, which has a slightly smaller diameter and is provided at the end of the roller portion, to form a double-step structure. Each of end roller portions 19*c* and 20*c* of rollers 19 and 20 is set to be higher than each of roller portions 19*b* and 20*b* in terms of hardness, exemplifying that each of roller portions 19*b* and 20*b* is made of a soft material and each of end roller portions 19*c* and 20*c* is made of a harder material than that of the material of roller portions 19*b* and 20*b*. Owing to this arrangement, roller portions 19*b* and 20*b* are deformed elastically to press end roller portions 19*c* and 20*c* with pressure, causing rollers 19 and 20 to be aligned and positioned in parallel with each other. A side wall sealed with upper and lower sealing members 56 and a pair of rollers 19 and 20 is thus formed. A sealing arrangement is made so that no liquid leakage may take place between both end portions of end roller portions 19*c* and 20*c* of rollers 19 and 20 and rear wall 53 as well as middle wall 54, and yet both rollers 19 and 20 may rotate.

Even if the hardness of material for both roller portions 19*b* and 20*b* is the same as that of material for both end roller portions 19*c* and 20*c*, there naturally is no problem regarding the sealing function.

The material for roller portions 19*b* and 20*b* of rollers 19 and 20 is not limited to rubber, but any material may be used if the material has with its sealing properties, flexibility, so as not to damage the surface of a light-sensitive material when it passes through the rollers and is not corroded by the developer. Besides rubber, polyester, organic high polymer material, felt material, and textile, others, for example, may be used. It is preferable that roller portions 19*b* and 20*b* are made of material which is slightly water-repellent, so that a light-sensitive material can pass through the roller portions smoothly without being scratched on its surface. The material of end roller portions 19*c* and 20*c* of rollers 19 and 20 is not limited to rubber but it is possible to use material which is identical to that for roller portions 19*b* and 20*b*.

Lower roller 19 of each pair of rollers 19 and 20 is located between washing section 4 and developing tank 5 and between developing tank 5 and washing section 6 roller 19 is positioned rotatably with its end 19*d* supported in bearing 58 buried in rear wall 53 without protruding therefrom as shown in FIG. 4. The other end 19*e* of the roller 19 is supported by bearing 59 mounted in front wall 55, across middle wall 54 and front wall 55. Between shaft portion 19*a* of roller 19 and middle wall 54, two O-rings 60 are positioned in a recessed portion 54*a* in middle wall 54. These two O-rings 60 are compressed, for sealing, by holder 61 which is screwed on shaft portion 19*a* when the holder 61 is turned and moved. On the flange portion 61*a* of holder 61, there are formed four cutouts 61*b* at four locations which are used for turning holder 61 by means of a tool.

As shown in FIG. 16, a holder 84 may also be fixed to middle wall 54 for sealing by means of set screws 85.

Gear 62 is provided at the tip of roller 19 and this gear 62 is engaged with gear 64 attached to driving shaft 63, and roller 19 is rotated by the rotation of driving shaft 63 that is driven by a motor which is not shown. The rotation of the lower roller 19 causes the roller 20, arranged in opposition, over the lower roller 19 to rotate, thus a light-sensitive material is transported through both rollers.

Shaft portion 20*a* of upper roller 20 is held rotatably with both of its ends 20*d* and 20*e* supported in bearings 65 and 66 installed in rear wall 53 and middle wall 54, respectively, and sealed so that no liquid leakage may take place.

In developing tank 5, guides 23 arranged vertically form a transport path for a light-sensitive material which causes a light-sensitive material to be transported smoothly in developing tank 5, kept hermetic. As shown in FIGS. 17–19, guide 23 is provided with screw holes 23*a* formed on the side of the guide, and is fixed on both rear wall 53 and middle wall 54 of developing tank 5 by means of unillustrated screws. On guide 23*b*, there are formed slits 23 in the direction of transport of a light-sensitive material at regular intervals, and owing to slits 23*b*, the area of contact between the guide and a light-sensitive material is reduced, which results in the reduction of contact resistance between the guide and the light-sensitive material for smooth transport thereof. Guide 23 may be made either of a porous plate as shown in FIG. 20 or of a mesh as shown in FIG. 23.

A light-sensitive material may be transported with its emulsion side facing either upward or downward. When the jet nozzle for circulation of the processing solution is provided at the lower portion of a processing tank, jets of processing solution are directed to the bottom of guide 23, on the emulsion side of the light-sensitive material so that it may be developed evenly and transported smoothly with less transport resistance for the light-sensitive material. The width of the transport path formed by guide 23 is one which is the sum of the width of a light-sensitive material and about 5 mm, for example, for the purposes of preventing zigzagging and jamming of the light-sensitive material.

Further, it is possible to reduce the resistance caused by friction between the light-sensitive material and guide 23 by providing an irregularity or streak pattern on the surface of guide 23 facing the light-sensitive material. Further, slit 23*b* with which guide 23 is formed can be arranged so that developers may be jetted in the direction of transport for a light-sensitive material, thus it is possible to transport the light-sensitive material more efficiently with the flow of developers.

The developer running through piping 68 connected to ejecting portion 67 located at the central part of developing tank 5 is heated by heater 26 and is jetted into developing tank 5 from a pair of supplying portions 70 led from piping 69 and arranged at both sides of ejecting portion 67.

Through the operation of this circulation system 24, the developer is splashed from the supplying part 70, providing a function to blow developer to the light-sensitive material and a function to agitate the developing solution in the developing tank 5 so as to keep the temperature constant. Besides, in the developing tank 5, the temperature sensor 71 is provided so as to receive temperature information for driving the heater 26.

The temperature of the developer is adjusted by the heater 26 provided in the circulating system 24. Especially, as the temperature adjusting method for small developing tank, it is preferred to be done in the circulating system 24 which is located outside of the developing tank 5, not inside of the developing tank.

Because the developing tank 5 is so small, the extremely narrow range of temperature control in the developing tank becomes very difficult when the heater is located in the developing tank 5 and the temperature is adjusted by ON-OFF operation of a big capacity heater. The temperature dispersion is generated in developing tank 5 and the fluid movement on the heating surface of the heater is small. Therefore, deterioration of the developer tends to happen. However, it is possible to set the heater 26 outside of the developing tank 5 to make abundant circulation of the developing solution in the developing tank so as to keep the temperature variation at a low level and the deterioration of the developer can be prevented.

The fixing tank and the washing tank are constituted in the same manner as the developing tank, but it is possible to provide a heater in the system 24 of the washing tank 9.

In the above-mentioned washing tank 4 and 6, the jet nozzles 27 are set. Through the operation of washing pump 72, washing water is supplied to the supplying part 75 from the washing water tank 73 through the duct 74. From the supplying part 75, washing water is jetted to the rollers 19 and 20 by the jet nozzle 27. In the water washing tank 73, the liquid level sensor 76 is provided to detect the remaining quantity of washing water.

Waste liquid remaining after washing that leaks when light-sensitive material is inserted through the rollers 19 and 20 is exausted to the waste liquid tank 77 through the duct 22. Moreover, into this waste liquid tank 77, leaked solution from the receiving stand 40 having processing solution, is drained through the duct 78.

It is possible to keep washing water constantly in this washing part (midway room) 4 and 6, to wash the rollers 19 and 20 constantly. Moreover, it is also possible to fill the washing part with materials having no influence on processing, such as fluid paraffin, inert gas and so on.

Figure 24:
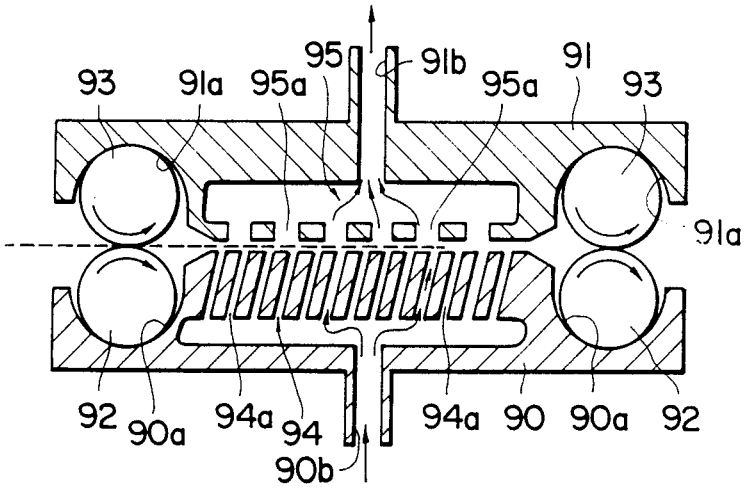
FIGS. 24(*a*)–(*e*) are cross sectional views of another example of the developing tank.

FIG. 24 shows another example of the processing tank in which the bottom wall 90 and the upper wall 91 face parallel to each other. Each pair of rollers 92 and 93 are arranged in each pair of concaves 90*a* and 91*a* provided at both ends of bottom wall 90 and upper wall 91, so that no leakage may take place substantially and yet the rollers may rotate. By rotation of these rollers 92 and 93, light-sensitive material passes between them, and it is fed into the transport path which is made by the guide 94 formed solidly with the bottom wall 90 and the guide 95 formed solidly with the upper wall 91. To the guide 94, slit 94*a* (directed in the direction of transport) is formed. Slit 94*a* introduces the processing solution supplied from the supplying part 90*b* located at the bottom through the operation of the circulating system, transporting light-sensitive material. The processing solution goes out of the transport path from slit 95*a*, which is formed in the guide 95, then is exhausted from the ejecting portion 91*b* for circulation.

Figures 25A, 25B, 25C:
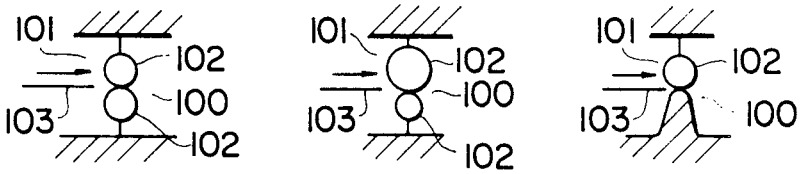
FIG. 25 shows a structure of a basic roller composition.
Figures 25D, 25E:
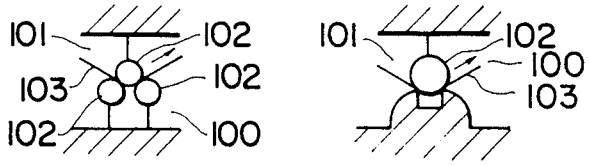

FIGS. 25, from (*a*) to (*e*), show forms of a basic roller structure (a) of FIG. 25(*a*), the same as the above-mentioned example, has a structure where the processing tank 100 and the air 101 is substantially sealed by a couple of the rollers 102 having the same diameter, so that light-sensitive material 103 is conveyed by rotation of the rollers 102. In (*b*) of FIG. 25, a couple of the rollers have different sized diameter. In (*c*) and (*e*) of FIG. 25, only one piece of roller 102 is used. FIG. 25(*d*) has three rollers 102.

Figure 26:
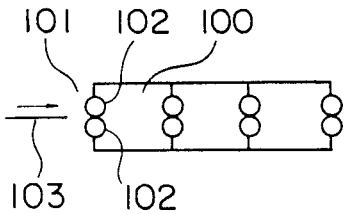
FIGS. 26(*a*)–(*b*) show the installation of the valve mechanism in the processing tank and the feeding of light-sensitive material.
Figure 26B:
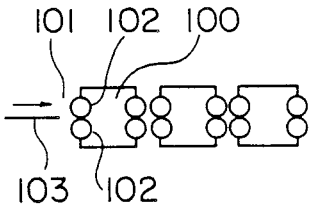
Figure 26C:
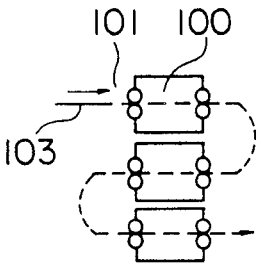
Figure 26D:
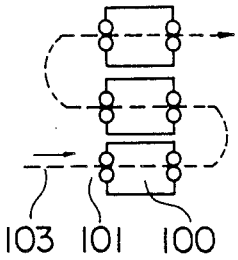
Figure 26E:
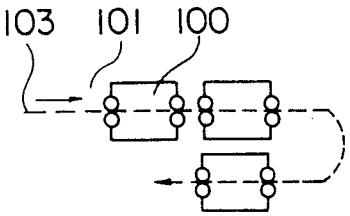
Figure 26F:
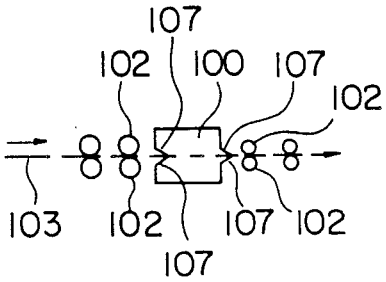
Figure 26G:
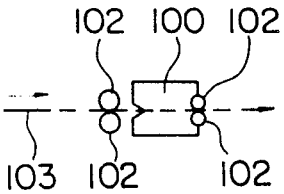
Figure 26H:
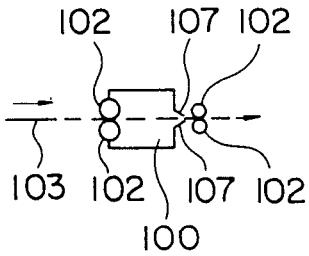
Figures 27A, 27B, 27C, 27D, 27E, 27F, 27G:
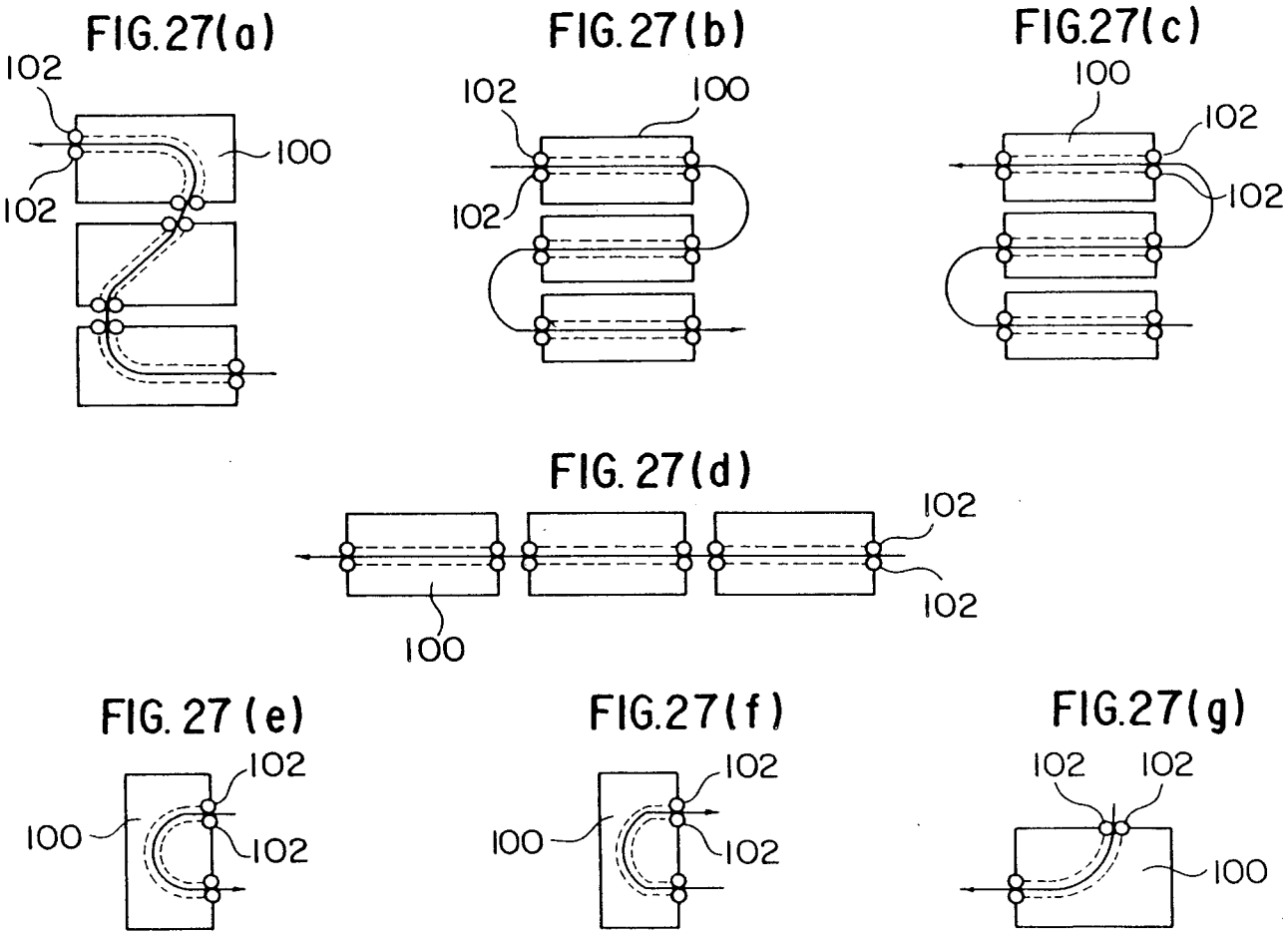
FIGS. 27(*a*) to (*p*) show the arrangement of the processing tanks and the feeding of light-sensitive material.
Figure 27J:
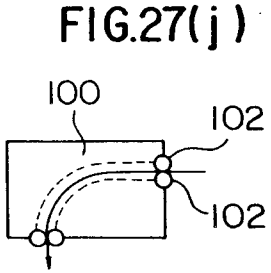
Figure 27M:
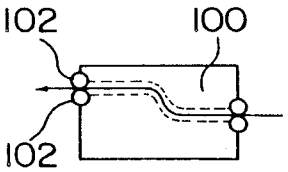
Figure 27P:
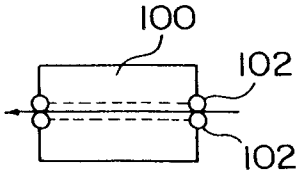
Figure 27I:
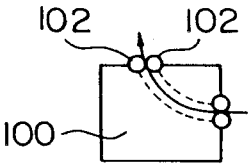
Figure 27L:
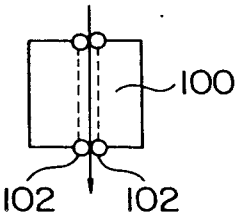
Figure 27O:
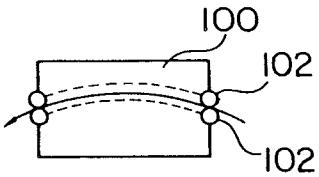
Figure 27H:
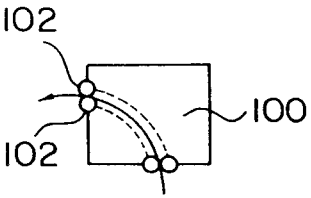
Figure 27K:
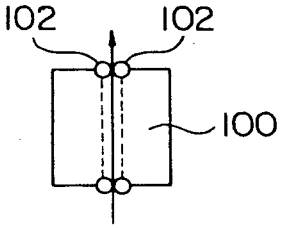
Figure 27N:
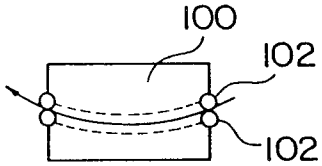

FIGS. 26, from (*a*) to (*f*), show the installation of a feeding-in and draining mechanism in the processing tank and the feeding of light-sensitive material. It is enough for the above-mentioned mechanism to have a single structure, i.e., one piece of valve, one roller and so on, but it is also good to have multi-structure, i.e., plural same mechanisms or plural different mechanisms in order to enhance the seal level of one wall surface. From (*a*) to (*e*) of FIG. 26 use the roller 102. In (*a*) of FIG. 26, three sets of processing tanks 100 are arranged succesively side by side, and light-sensitive material 103 is fed from the side direction. In (*b*) of FIG. 26, three sets of the developing tank 100 are arranged independently side by side. In (*c*) of FIG. 26, the processing tanks 100 are arranged vertically. Light-sensitive material 103 is fed from the upper side to the bottom side. In (*d*) of FIG. 26, light-sensitive material 103 is conveyed from the bottom side to the upper side. In (*e*) of FIG. 26, two sets of the processing tank are located in the upper side and one set of the processing tank in located in the bottom side. In (*f*) of FIG. 26, a valve seal 107 is used and a roller 102 is used for the feeding of light-sensitive material. In (*g*) and (*h*) of FIG. 26, roller 102 and valve seal 107 are jointly used.

FIGS. 27, from (*a*) to (*p*) show other examples of the arrangement of the processing tanks 100 and the different feeding directions of light-sensitive material 103

Figure 28:
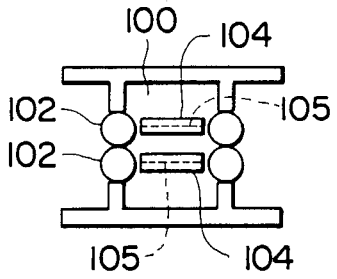
FIGS. 28–30 are examples of the temperature adjustment of the processing solution.
Figure 31:
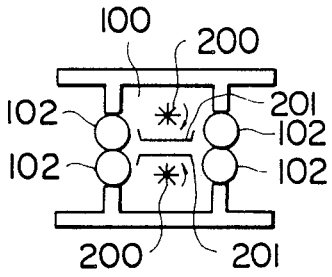
FIGS. 31–33 show agitation in the processing tank.
Figure 29:
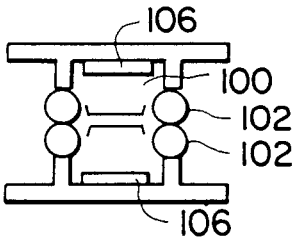
Figure 32:
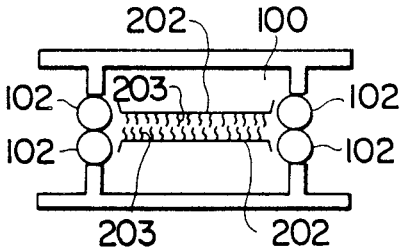
Figure 30:
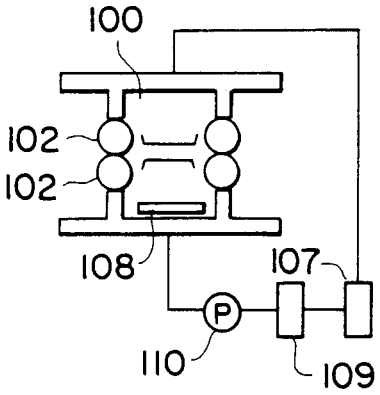
Figure 33:
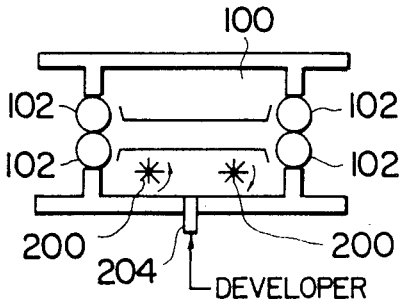

FIGS. 28–30 show other examples of the temperature adjustment of processing solutions. FIG. 28 shows that the heater 105 is built in the guide 104 of the processing tank 100. This heater 105 may be of either a plate-type or a bar-type. FIG. 29 includes heater 106 in the processing tank 100. This heater 106 may also be of either a plate-type or a bar type. FIG. 30 shows that the processing tank 100 has heater 107 of a big capacity located outside the tank and heater 108 of a small capacity is located inside the tank. The enhancement of temperature is mainly done by the external heater and temperature control is made by the inner heater so that the range of temperature variation can be smaller. FIGS. 31–33 show examples of agitation in the processing tank. In FIG. 31, near the guide member 200, an agitation blade 200 is set and is driven by the outer motive power to agitate the processing solution. In FIG. 32, curtain-type or yarn-type material 203 is provided from the guide face of the guide member 202 to the transport path for light-sensitive material. When a light-sensitive material passes through this member 203, it is shaken to agitate the processing solution. In FIG. 33, the processing solution is jetted from the supplying inlet 204 to rotate the agitation fan 200 to agitate the solution.

In this example, we will discuss the relation between the hole-opening ratio of the slit of the guide member and the developing unevenness, and the relation between the linear speed of the jetted processing solution and the developing unevenness.

Figure 34:
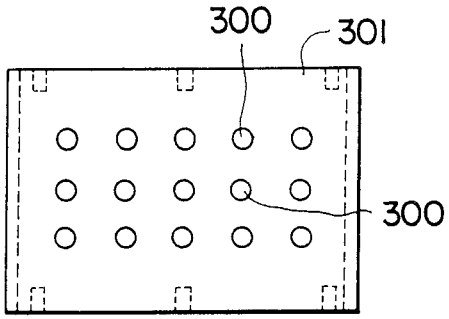
FIG. 34 shows a plan view of the guide used in the examination.

At first, we examined the relation between the hole-opening ratio of the open-portion 300 to the guide member 301 and the processing unevenness shown in FIG. 34. The result is shown in Table-1.

TABLE 1

The relation between the hole-opening ratio and the developing unevenness. (The linear jetting speed : 2 cm/sec.)

| The hole-opening ratio (%) | 5 | 10 | 15 | 20 | 25 | 30 | 35 | 40 |
|---|---|---|---|---|---|---|---|---|
| The developing unevenness | X | X | Δ | O | O | O | O | O |

X: Developing unevenness happens.
Δ: Only little developing unevenness happens.
O: Developing unevenness cannot happen.

Therefore, the hole-opening ratio of the guide member must be set to 20%, or more.

Then, we examined the relation between the linear jetting speed against light-sensitive material and the developing unevenness by use of the above-mentioned guide member 301. The result is shown in Table-2. In this examination, we set the hole-opening ratio of the guide member to be 50%.

TABLE 2

The relation between the linear jetting speed against light-sensitive material and the developing unevenness.

| Linear jetting speed to light-sensitive material (cm/sec.) | 0.5 | 1.0 | 1.5 | 2.0 | 3.0 | 4.0 | 5.0 |
|---|---|---|---|---|---|---|---|
| Developing unevenness | X | Δ | O | O | O | O | O |

X: Developing unevenness happens.
Δ: Developing unevenness happens only little.
O: Developing unevenness cannot happen.

Therefore, the linear jetting speed of the processing solution to the light-sensitive material by use of the guide member (301) must be set to 1.5 cm/sec, or more.

Figure 35:
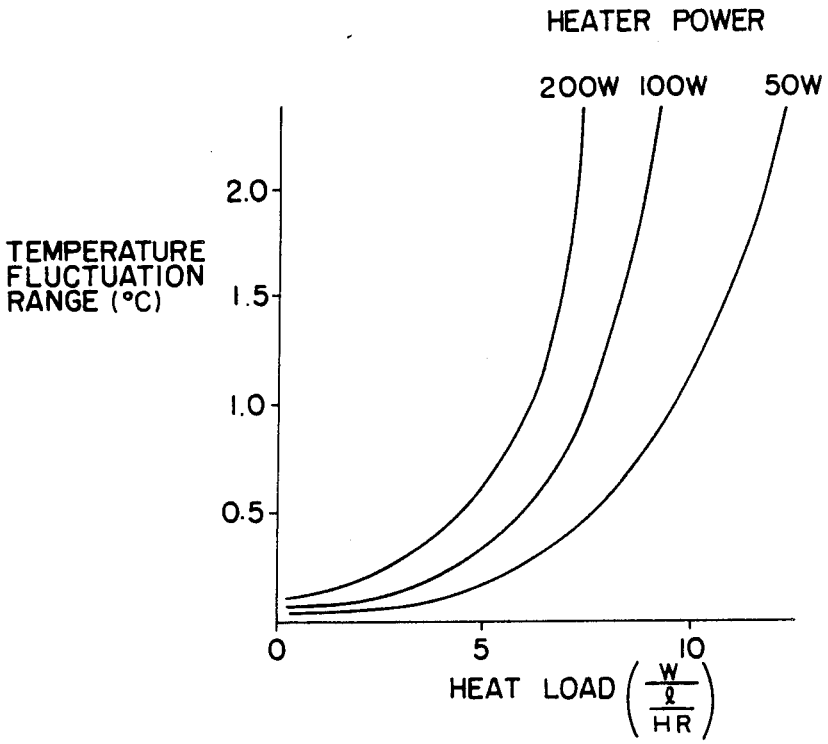
FIG. 35 shows the relationship between the range of controlled temperature and the heat load.

Moreover, we examined the relation between the controlled temperature range and the heat load amount (=heater output/circulation liquid amount), whose result is shown in FIG. 35.

Figure 36:
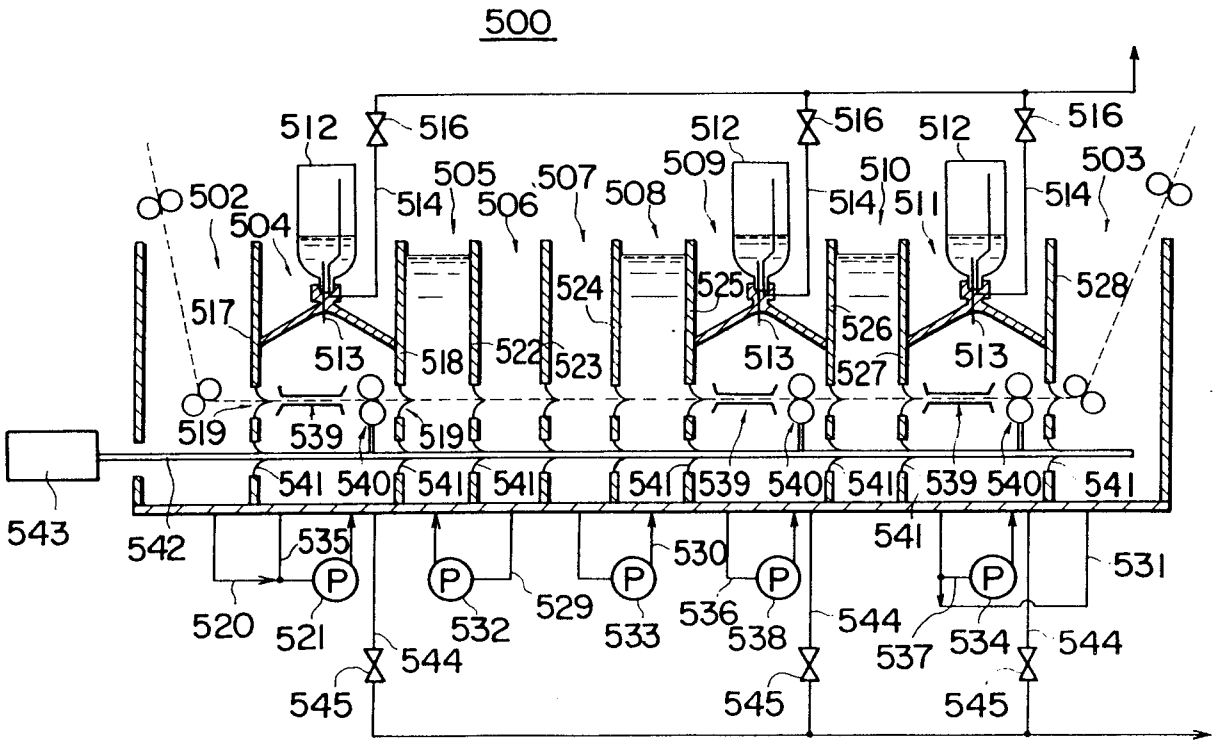
FIG. 36 is a sectional view showing another example of the light-sensitive material processing apparatus.
Figure 37:
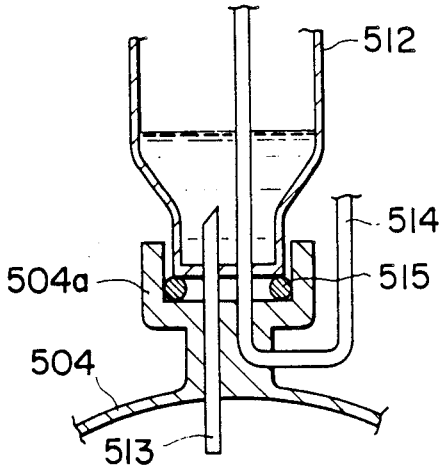
FIG. 37 shows an installation condition of the replenisher tank on the processing tank.

FIG. 36 is a cross-sectional view of another example of an apparatus for processing a light-sensitive material. A symbol 500 in the drawing represents an apparatus main body which is light-proof against external light and light-sensitive material inlet portion 502 is provided on one side of the apparatus main body 500, while on the other side thereof, light-sensitive material outlet 503 is provided. Between light-sensitive material inlet portion 502 and light-sensitive material outlet 503, there is provided developing tank 504, water tank 505, air tank (midway room) 506 and 507, water tank 508, fixing tank 509, water tank 510 and washing tank 511, in the sequence thereof from the side of light-sensitive material inlet portion 502. In these processing tanks, there is stored developer, fixer and washing water respectively, and replenisher containers 512 are connected to the upper portion of processing tanks. As shown in FIG. 37, between developing tank 504 and replenisher container 512, there is provided a tube 513 having a sharp tip disposed in connecting portion 504*a* located on the upper portion of developing tank 504, thus, developing tank 504 and replenisher container 512 are connected so that a liquid therin may flow through the connection. Further, in replenisher container 512 there is provided an air tube 514 through which air may . A bottom portion of replenisher container 512 is mounted on the connecting portion of developing tank 504 through seal member 515, therefore, a liquid-level of processing solution is formed in replenisher container 512 located outside developing tank 504, so the developer is kept substantially hermetic. On the air tube 514, there is provided a valve 516, through which the developer tank 504 is kept hermetic. When the valve 516 is operated for replenishment of developer, air is introduced into replenisher container 512 and thereby the developer is supplied to developer tank 504 and the liquid-level in replenisher container 512 is lowered. Replenisher containers 512 which have the same structure as replenisher container 512 for developer tank 504 are also provided above fixing tank 509 and washing tank 511, respectively. A valve seal 519 is provided on the wall portion 517 that separates developer from air and also it is provided on the wall portion 518 that separates developer from water, thus developing tank 504 is kept hermetic, and light-sensitive material can be fed-in and ejected through them. Developing tank 504 is substantially kept hermetic, and by making the clearance of valve seal 519 small, leakage of solution caused when light-sensitive material is fed-into from valve seal 519 is reduced.

A light-sensitive material is fed in through valve seal 519 on the side of light-sensitive material inlet portion 502 and ejected through valve seal 519 on the opposite side, thus, the light-sensitive material can be fed into processing solutions and ejected therefrom directly and thereby the deterioration of the developer in developing tank 504 caused by oxidization can be prevented. Between developing tank 504 and light-sensitive material inlet portion 502, there is provided a solution-returning tube 520 which sends back the solution slightly leaked from developing tank 504 when light-sensitive material is inserted through valve seal 519 by driving pump 521. It is preferable for the material of the valve seal 519 to be flexible enough not to scratch the surface of a light-sensitive material and yet is not eroded by developing solution, so organic high polymer materials such as, for example, polyester sheet, vinyl-chloride resin sheet and nylon sheet are preferably used. Further, it is preferable for the material of a sheet for valve seal 519 to be somewhat water-repellent because a light-sensitive material can pass through the sheet smoothly without being scratched on its surface.

Figure 38:
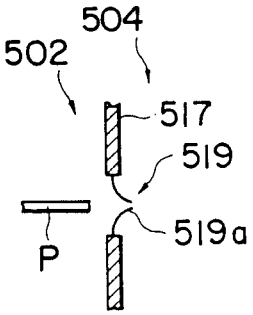
FIG. 38 and FIG. 39 show cross sectional views of the valve device.
Figure 39:
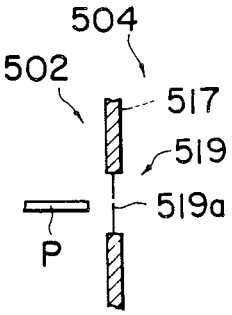
Figure 40A:
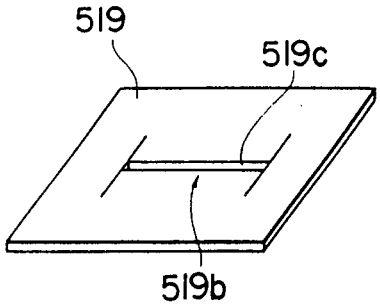
FIGS. 40, from (*a*) to (*d*) show preparation of the valve device
Figure 40B:
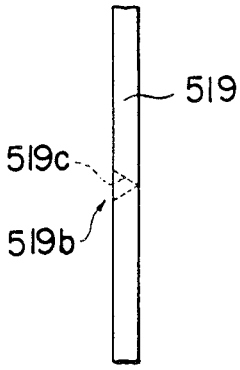
Figure 40C:
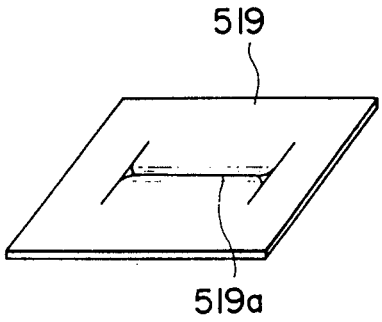
Figure 40D:
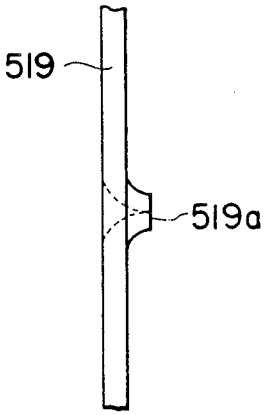

The valve seal 519 is formed as shown in FIG. 38 and FIG. 39, and as shown in FIG. 38 and curves toward the transportation direction of light-sensitive material (P). Thus, the pressure caused by the developer in developing tank 504 is applied on the insertion-inlet portion 519*a* so that it may close, thereby leakage from the insertion-inlet portion 519*a* is prevented.

Figure 41:
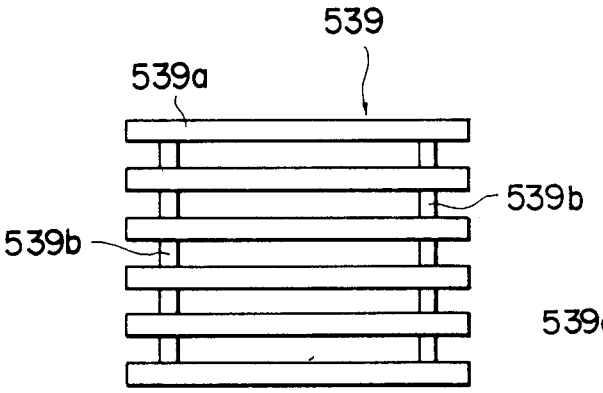
FIG. 41 is a plan view of the guide and FIG. 42 is a right side view of FIG. 41.
Figure 42:
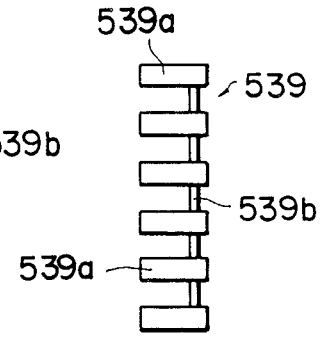

As shown in FIG. 40(*a*) and (*b*), a square sheet member is given a H-shaped cut 519*b* and mating portions of the flaps caused by the H-shaped cut are formed like a V-shaped notch 519*c* on valve seal 519. As shown in FIG. 40 (*c*), the portion of the V-shaped notch 519*c* on the flap is protruded in the direction perpendicular to the V-shaped notch and thereby the insertion-inlet portion 519*a* shown in FIG. 40(*d*) is formed. The water level in water tank 505 provided on the outlet side of developer tank 504 is made to be almost the same as that of processing solution and thereby the liquid pressure caused by the developer applied on the valve seal 519 is balanced with the water pressure. Thus preventing the leaked developer from mixing with water. Wall portion 522 which separates water tank 505 and air tank 506, wall portion 523 which separates air tank 506 and air tank 507, wall portion 524 which separates air tank 507 and water tank 508, wall portion 525 which separates water tank 508 and fixing tank 509, wall portion 526 which separates fixing tank 509 and water tank 510, wall portion 527 which separates water tank 510 and washing tank 511, and wall portion 528 which separates washing tank 511 and light-sensitive material ejecting portion 503 are all provided with the aforesaid valve seal 519 through which a light-sensitive material passes and transported. Water tank 508 is provided at the inlet side of fixing tank 509 and water tank 510 is also provided between fixing tank 509 and washing tank 511. Water level in the water tank 508 and that in the water tank 510 are mostly the same as those of fixing solution and washing liquid respectively and thereby the liquid pressure applied on the valve seal 519 is balanced, preventing that each of the fixing solution and washing liquid is not mixed with water. Returning tubes 529, 530 and 531 are provided between water tank 505 and air tank 506 in the next stage, between air tank 507 and water tank 508, and between washing tank 511 and light-sensitive material ejecting portion 503, respectively, and each of them returns through the operation of each pumps 532, 533, and 534, the leaked liquid to its original tank. Further, developing tank 504, fixing tank 509 and washing tank 511 are respectively provided with tubes 535, 536 and 537 through which the processing solutions are circulated by the works of pumps 521, 538 and 534, respectively. Besides, developing tank 504, fixing tank 509 and washing tank 511 are respectively provided therein with transport guide 539 and transport rollers 540. Each transport rollers 540 is given a driving force for its rotation, through a power transmission mechanism such as bevel gears or the like, by the driving shaft 542 which passes through the valve mechanism 541 located on each wall portion, and the driving shaft 542 is rotated by motor 543. Valve seal 541 through which the driving shaft 542 is held, is supported so that driving shaft 542 can be rotated. At the same time, valve seal 541 seals the gap between the driving shaft 541 and the wall portion to prevent liquid leakage. As shown in FIG. 41 and FIG. 42, on transport guide member 539 which consists of a plurality of sheet materials 539*a* arranged in the transport direction at a certain interval and of a connecting material 539*b*, the sheet materials 539*a* realize the reduction of the contact area between a light-sensitive material and the transport guide for the smooth transportation and of enabling processing solution to circulate through the clearance between the sheet materials. Further, all of developing tank 504, fixing tank 509 and washing tank 511 are connected to a drain pipe 544, through which liquid is discharged when valve 545 is operated. Besides, it is possible to provide a means to control the temperature of the processing solution and a means to agitate the processing tank, just like the previous example.

In the previous examples, the processing tank is kept hermetic, and when the content of processing solution becomes decreased by the processing of light-sensitive materials, the processing solution is replenished from the replenisher container located on the upper side of the processing tank through its contact with outer air. Therefore, entering of air in the developer is prevented. The replenisher container can also be positioned on the lower level when the replenisher is replenished compulsorily by means of pumps or other.

As stated above, in the light-sensitive material developing apparatus, the processing tank is substantially kept hermetic from outer air. So, the processing solution does not contact with air in the processing tank, and thereby it is possible to prevent the deterioration caused by oxidization or evaporation of processing solution observed in the conventional processor, and the inside of each processing tank is not contaminated.

Besides, it is possible to compose the processing tank wall portion with a valve mechaniam through which a light-sensitive material can be fed into the processing tank. Besides, as the processing tank is substantially kept hermetic, the leakage of solution during feeding-in and ejection of light-sensitive material can mostly be prevented.

Besides, when the feeding-in and ejecting mechanism is prepared with a roller structure, the valve mechanism can have a function to stock processing solution as a wall portion of a processing tank. Moreover, the rotation of the roller can feed light-sensitive material into the developing tank. Thus, it is not necessary to provide another special feeding mechanism.

By supplying replenisher into the processing tank, the deteriorated processing solution is compulsorily ejected from the processing tank kept substantially hermetic, through the clearance, such as the sealing portion of a valve type, so a problem such as the clogging with a chloride and so on deteriorated through the opening of the seal part and so on cannot happen. Besides, by providing the mechanism to release the hermetic condition of the processing tank and by releasing the hermetic condition of processing, the supply or draining of processing solution can be done easily.

Moreover, a water tank which has the same water pressure as that of processing solution, can be provided in the midway room between the feeding-in and ejecting mechanisms of the processing tank connected to these feeding-in and ejecting mechanisms, thereby solution leakage which happens when a light-sensitive material passes can be prevented.

Also, it is possible to fill the midway room with materials which do not react with the processing solution, such as fluid paraffin, inert gas and so on, to prevent oxidization of the processing solution. Moreover, if a transport mechanism is provided in the processing tank, a light-sensitive material can be fed without the leakage of solution and without transport trouble like jamming and so on.

Further, it is possible to prevent processing unevenness on light-sensitive material by jetting the processing solution against the light-sensitive material for agitation in the processing tank and by heating the processing solution with a circulation system for maintaining the processing solution at a predetermined processing temperature.

What is claimed is:

1. A photosensitive material processing apparatus for developing a photosensitive material, the apparatus comprising:

a main body;

first conveyance means in connection with the main body for conveying the photosensitive material into the main body;

second conveyance means in connection with the main body for conveying the photosensitive material out of the main body;

developer enclosure means disposed in the main body, the developer means having a processing solution therein;

wash enclosure means connected to the developer enclosure means for preventing the processing solution from oxidizing by air or hardening by evaporation;

photosensitive material intake means in the developer enclosure means for feeding the photosensitive material into the developer enclosure means;

photosensitive material discharge means located between the developer enclosure means and the wash enclosure means for discharging the photosensitive material from the developer enclosure means into the wash enclosure means, the photosensitive material intake and discharge means isolating the developer enclosure means from outside air to maintain the developer enclosure means in a hermetic condition and prevent the developing solution from leaking from the developer enclosure means during processing; and wash enclosure discharge means located in the wash enclosure means for discharging the photosensitive material from the wash enclosure means, the wash enclosure and photosensitive material discharge means isolating the wash enclosure means from outside air to keep the wash enclosure means in a hermetic condition.

2. The apparatus of claim 1 further comprising guide means disposed in the developer enclosure means for smoothly transporting the photosensitive material through the developer enclosure means.

3. The apparatus of claim 2 wherein the guide means include apertures for directing jets of the processing solution toward the photosensitive material as the photosensitive material passes through the developer enclosure means.

4. The apparatus of claim 3 wherein the apertures have a size for maintaining a speed of the jets of processing solution of at least 1.5 cm/sec.

5. The apparatus of claim 3 wherein the apertures are present at least 20% of the guide means.

6. The apparatus of claim 3 further comprising circulating means in fluid communication with the developer enclosure means for circulating the processing solution.

7. The apparatus of claim 1 wherein the processing solution in the developer enclosure means is a developing solution.

8. The apparatus of claim 1 wherein the wash enclosure means includes cleaning means for cleaning the photosensitive material intake and discharge means.

9. The apparatus of claim 1 wherein the photosensitive material intake means and the photosensitive discharge means comprise a pair of rollers.

10. The apparatus of claim 1 wherein the photosensitive material intake means and the photosensitive discharge means comprise flexible valve devices.

11. The apparatus of claim 1 wherein said wash discharge means comprises a pair of rollers.

12. The apparatus of claim 1 wherein said wash discharge means comprises a flexible valve device.

13. The apparatus of claim 1 further comprising releasing means in communication with the developer enclosure means for releasing the hermetic condition of the developer enclosure means.

14. A photosensitive material processing apparatus for developing a photosensitive material, the apparatus comprising:

a main body;

first conveyance means connected with the main body for conveying the photosensitive material into the main body;

second conveyance means connected with the main body for conveying the photosensitive material out of the main body;

developer enclosure means in the main body, containing a processing solution;

wash enclosure means connected to the developer enclosure means for preventing the processing solution from oxidizing or hardening;

photosensitive material intake means in the developer enclosure means for feeding the photosensitive material into the developer enclosure means;

photosensitive material discharge means located between the developer enclosure means and the wash enclosure means for discharging the photosensitive material from the developer enclosure means into the wash enclosure means, the photosensitive material intake and discharge means isolating the developer enclosure means from outside air to maintain the developer enclosure means in a hermetic condition and prevent the developing solution from leaking from the developer enclosure means during processing;

cleaning means in the wash enclosure means for cleaning the photosensitive material intake and discharge means; and wash enclosure discharge means for discharging the photosensitive material from the wash enclosure means, the wash enclosure and photosensitive material discharge means isolating the wash enclosure means from outside air to maintain the wash enclosure means in a hermetic condition.

* * * * *